US007798429B1

(12) United States Patent
Porter

(10) Patent No.: US 7,798,429 B1
(45) Date of Patent: Sep. 21, 2010

(54) HANDHELD SPRAY RECEPTOR

(75) Inventor: Barry Porter, Bridgewater, MA (US)

(73) Assignee: Enviro Caddie LLC, Brockton, MA (US)

( * ) Notice: Subject to any disclaimer, the term of this patent is extended or adjusted under 35 U.S.C. 154(b) by 1555 days.

(21) Appl. No.: 10/179,088

(22) Filed: Jun. 25, 2002

(51) Int. Cl.
*B05B 7/02* (2006.01)
*B05B 7/30* (2006.01)

(52) U.S. Cl. ..... 239/525; 239/353; 239/359

(58) Field of Classification Search ..... 239/525, 239/527, 528, 353, 359, 372; 222/318, 630, 222/637

See application file for complete search history.

(56) References Cited

U.S. PATENT DOCUMENTS

| | | | |
|---|---|---|---|
| 585,503 | A | 6/1897 | Black |
| 587,890 | A | 8/1897 | Weaver |
| 888,693 | A | 5/1908 | Bustuniza |
| 1,733,724 | A | 10/1929 | Downs |
| 1,892,535 | A | 12/1932 | Sanders |
| 2,519,707 | A | 8/1950 | Schaffer |
| 3,025,006 | A | 3/1962 | Maurath |
| 3,042,310 | A | 7/1962 | Franke et al. |
| 3,801,015 | A | 4/1974 | Hayes |
| 4,135,669 | A | 1/1979 | Bridges et al. |
| 4,154,401 | A | 5/1979 | Thompson |
| 4,432,474 | A | 2/1984 | Hutchinson et al. |
| 5,186,391 | A | 2/1993 | Roueche et al. |
| 5,785,245 | A | 7/1998 | Tedders et al. |
| 6,279,837 | B1 | 8/2001 | Porter |
| 2009/0057436 | A1 * | 3/2009 | Valdes et al. ..... 239/9 |

OTHER PUBLICATIONS

Spraying Systems Co., Drawing 9079, Jul. 6, 1981, Wheaton, IL.

* cited by examiner

*Primary Examiner*—Davis Hwu
(74) *Attorney, Agent, or Firm*—Banner & Witcoff, Ltd.

(57) ABSTRACT

The handheld spray receptor provides an apparatus which, when used with a supply of a liquid under pressure, dispenses a liquid material in a pattern that is controlled by an inexpensive and disposable actuator. Such actuators are employed as an industry standard part that would be found on any aerosol spray can, and feature small cylindrical actuators that may be easily interchanged, so as to provide varied spray patterns. A purging model provides for a quick and convenient method of purging liquid from the actuator, so as to prevent hardening of liquid material exposed to the atmosphere, and a subsequent clogging of the receptor. When used with a supply of liquid under pressure and access to a propellant, the handheld spray receptor significantly reduces the amount of hazardous waste, in the form of partially consumed aerosol cans, that would otherwise enter landfills or hazardous waste recycling facilities.

7 Claims, 13 Drawing Sheets

HANDHELD SPRAY RECEPTOR

BACKGROUND OF THE INVENTION

1. Field of the Invention

The handheld spray receptor provides an alternative method of dispensing liquids under pressure, as might be alternatively accomplished with an aerosol container, or a traditional spray gun. Traditional aerosol cans often dispense hazardous materials, and when the actuator or vertical valve on an aerosol can becomes clogged, the entire can becomes useless, and is often discarded improperly, creating a hazard.

Cleaning out the actuator and vertical valve of an aerosol can is difficult and often ineffective. A purging capability can be approximated with an aerosol can, but requires expensive equipment specially designed, in most instances.

2. Description of Prior Art

The most traditional method of selling and dispensing liquid materials is by way of the traditional aerosol can. The propellant utilized in traditional aerosol cans is often hostile to living beings, and as such provides a hazard to the user of the aerosol can, as well as a pollutant to the environment as a whole. Aerosol cans also provide poor economy for viscous liquids. Viscous liquids must be thinned with a material which is often detrimental to the user and the environment, such as paint thinner or methyl alcohol. It is not uncommon for a consumer to receive an aerosol product with 90% thinner, and 10% product, making the aerosol can an expensive method of delivering product. An aerosol can may purge the material in the feed tube and actuator button, by holding the can upside down and depressing the actuator button, but this can cause the propellant to become exhausted, rendering the aerosol can useless, even though there may be additional liquid still in the can. In addition, the actuator button often becomes clogged, causing the remaining liquid to be unusable. Aerosol cans create a major disposal problem, when they become empty, and are hazardous materials that must be properly handled to be safely disposed of.

A variant of the traditional aerosol can is the aerosol powered foam container, as might be used to dispense shaving cream. These cans typically utilize an actuator that is crimped to the mouth of the can, accompanied by a slot or other large flow opening which releases the material rather than spraying it. U.S. Pat. No. 5,027,986 provides an example of this kind of application.

Other mechanisms utilize an extension tube and a piston effect to dispense liquid in a flow, not a spray. U.S. Pat. No. 3,346,194 provides an example of this kind of dispenser.

Lawn and garden sprayers have been developed which dispense liquid materials under pressure. These are often provided with a compression pump, allowing the operator to pressurize the liquid in the tank, and to release fertilizer, herbicides, or pesticides (or any other liquid that might be useful in gardening) by means of a trigger mechanism. U.S. Pat. No. 5,307,995 discloses an enhanced method of attaching a hose to such a sprayer. U.S. Pat. No. 6,278,837 discloses a sprayer with a traditional vertical action valve assembly.

Inventions directed to dispensing personal care products perform similar functions. U.S. Pat. No. 3,190,502 discloses an invention that will dispense shampoo in a commercial shop, such as a beauty salon or a barber shop. A fixed electrical pump is used to create pressure on the tank of liquid to be dispensed, and the handheld receptor creates a flow of shampoo, and not a spray of material.

Handheld pump sprayers are available to dispense insecticides, such as the spray pumps that come attached to ant or roach poison products sold in hardware and lawn and garden stores. The dispensed material is typically carried in one hand, and the other hand dispenses materials by squeezing the handle in a repeated fashion, so as to cause the liquid to be dispensed in a spray or a single stream. Such systems have also been developed to dispense cooking oil, or other such viscous liquids. U.S. Pat. No. 5,718,383 discloses a handheld pumping mechanism attached to a feed hose, so that vegetable oil may be sprayed on a cooking surface. The liquid is not under pressure, and the operator provides the mechanical energy required to operate the hand pump, thereby controlling the amount of material dispensed.

A traditional spray-gun, as might be utilized to spray paint, utilizes an air compressor to provide pressure, and typically features a container into which the liquid to be sprayed is placed. Some spraying systems have been developed specifically for dispensing a measured amount of material from an aerosol can. U.S. Pat. No. 5,427,281 utilizes a reservoir onto which an vertical action valve assembly is attached. Both a traditional spray-gun and a device with a reservoir have the problem of cleaning out the residual material upon last use of the day. When used to dispense materials that harden when exposed to air, such as paint, both the reservoir and the actuator must be purged of material.

U.S. Pat. No. 5,170,939 discloses a handheld paint sprayer which does not contain a reservoir, but which provides a special valve which directs compressed air through the spray actuator while insuring that no compressed air causes "backflow" of the liquid intake hoses. Like many other actuator assemblies, cleaning of the actuator and valve assemblies is time consuming and complicated.

The cleaning of actuators, also referred to as nozzles, can be accomplished with specialized and dedicated equipment. U.S. Pat. No. 6,355,114 B1 demonstrates an apparatus for forcing solvent through one or more nozzles, and capturing the spray for reuse, or for disposal.

When portability is not required, there are a number of inventions which provide purging capabilities. U.S. Pat. Nos. 5,803,109 and 6,116,261 are examples of mechanisms employed in automated paint application systems, as might be found in an automotive assembly plant. These systems employ complex automation to engage the purge cycle, and are integrated into a factory's equipment.

Large industrial paint systems, which are designed to change the color of paint applied on a frequent basis, often include a purging capability. U.S. Pat. Nos. 3,981,320; 4,232,055; 5,072,881; 3,240,225; and 3,716,191 are examples of large industrial systems designed with purge capabilities. The purge capability is included to permit a single nozzle or set of nozzles to be supplied with different colors of paint, without disassembling the equipment for cleaning.

Systems designed to dispense special materials, such as powder paint, also employ purging systems. U.S. Pat. Nos. 6,112,999 and 6,315,214 provide examples of systems that dispense special paints, and employ a purging capability. Specialized amine-assisted systems disclosed in U.S. Pat. No. 4,862,196 also employ purging systems to clean the nozzle of the mechanism.

The prior art provides solutions for the casual consumer, such as a typical homeowner, and for the major industrial factory. The consumer on a shop floor, such as a maintenance depot, finds aerosol cans to be hazardous, ineffective, wasteful, and expensive. A simple handheld receptor, made from standard parts or easily manufactured parts, has not been available to a facility that is otherwise forced to use many aerosol cans, or expensive equipment that is not cost effective. Such a handheld receptor is the object of this invention, through a model that dispenses a liquid which is not prone to clog the nozzle on the actuator, as well as a model that provides a simple purging mechanism, for use with paints and other liquids which have a tendency to clog the actuator.

SUMMARY OF THE INVENTION

The invention features a handheld body incorporating an actuator that would be found on any aerosol spray can. By utilizing a standard part incorporated in aerosol spray cans, maintenance costs and manufacturing costs are minimized. In one embodiment, a purge capability is provided so as to preserve the usefulness of the actuator by blasting out any material that might harden when contact is made with the atmosphere, such as when paint is dispensed. Different spray patterns are easily achieved by replacing the cylindrical actuator button component of the spray actuator.

One of the main advantages of the invention is the reduction of discarded standard aerosol cans, and the hazardous material they often contain. When traditional aerosol cans clog, either due to the actuator clogging with dirt or dried liquid, such as paint, or due to the vertical valve clogging—the consumer often discards the can and whatever contents remain in the can.

DESCRIPTION OF THE PREFERRED EMBODIMENT

The preferred embodiment of the invention is shown in FIG. 1. The handheld receptor 1 features a pistol handle assembly 2 which has a pistol handle trigger 3, which, when operated with the index finger of an operator presses the actuator 12 downward, releasing a spray of material dispensed by the handheld receptor 1. A cylindrical shaped receptor body 5 utilizes a needle valve assembly 6 on opposite sides to control the flow of propellant entering through an inlet propellant tubing 8 through a tubing connector assembly 7, or controls the flow of dispensed liquid fed to the handheld receptor 1 through the dispensing liquid tubing 9 through a tubing connector assembly. An valve locking ring 4 holds the vertical action valve assembly to the receptor body 5. Two flat surfaces 26 are provided to assist in securing the cylindrical receptor body 5, by means of a wrench or vise, so as to tighten the threaded tubing connector assemblies 7 to the receptor body 5. In the preferred embodiment the pistol handle assembly 2 is a commercially available product constructed of plastic, the vertical action valve assembly 11 is a standard part as would be employed in the manufacturing of traditional aerosol spray cans, the seals 13, 16 are of a material appropriate for the liquid being dispensed. For dispensing paint, a butyl material is preferred; for brake cleaner and penetrant, a buna seal is preferred; Teflon works well for many other liquids, and rubber seals are appropriate for some liquids. The tubing 8, 9 is a commercially rated Teflon FEP (fluorinated ethylene propylene), and the remaining parts are machined aluminum. Any material that is either machinable or moldable could be employed to construct the handheld receptor 1, e.g. plastic, brass or stainless steel.

The purging model of the handheld receptor 1 permits the operator to close the needle valve assembly 6 that provides a flow of liquid dispensed, such as paint, and by opening the opposite needle valve assembly 6, force air or a propellant through the vertical valve assembly 11 and actuator 12 thereby clearing any material from the vertical valve assembly 11 and the actuator 12, thereby eliminating the need to clean the vertical valve assembly 11 and the actuator 12. When the handheld receptor 1 is used in conjunction with a tank that dispenses liquid under pressure, using gas compressed to serve as a propellant, the two feed lines to the handheld receptor 1 provide an integrated solution.

FIG. 2 depicts an exploded view of the handheld receptor 1, without the pistol handle assembly 2. A receptor body 5 incorporates an vertical action valve assembly 11 which provides a actuator 12 for dispensing liquids. An insert 10 provides a ridge for attaching the pistol handle assembly 2. The insert 10 and vertical action valve assembly 11 are held in place with the valve locking ring 4. The receptor body 5 may be held stationary by means of two parallel flat surfaces 26 secured with a traditional wrench or vise, permitting the tubing connector assemblies 7 to be secured by means of a threaded end to the receptor body 5. The valve locking ring 4 should be hand tightened. Two tubing connector assemblies 7 provide for the secure attachment of tubing that supplies propellant for purging the vertical valve assembly 11 and actuator 12, and liquid to be dispensed through the actuator 12. Needle valves comprise a needle valve seal 13 that prevents leakage from the receptor body 5, a needle valve seat 14, a detente pin 15 which prevents the needle valve stem 17 from being removed completely from the needle valve seat 14, a needle valve stem seal 16 that prevents leakage from the needle valve seat 14, and the needle valve stem 17.

FIG. 2*a* shows a top view of the insert 10, showing two straight edges 10*a* which are parallel and opposing to one another, so as to provide a lip for attaching an optional pistol handle assembly 2. When inserted, the pistol handle assembly 2 is inserted into the elongated opening defined on the sides by the two parallel edges on the insert 10, and once inserted, the pistol handle assembly is twisted a quarter turn so that the pistol handle assembly is pointed in a direction that is perpendicular to the two parallel edges in the insert 10.

FIG. 2*b* shows a perspective view of the insert 10, with a cross section selected from a point on the insert 10 that defines the end of the slot into which the optional pistol grip assembly 2 would be first inserted, or from which the pistol grip assembly 10 would be removed. In the preferred embodiment of this insert design, the outer diameter is 1.15 inches, the diameter of the inner circular opening is one inch, the straight edges are eight tenths of an inch apart, and the insert is 0.025 inches thick.

FIG. 3 depicts a cross-section, exploded view of the handheld receptor 1, without the pistol handle assembly 2. A receptor body 5 incorporates an vertical action valve assembly 11 which provides a actuator 12 for dispensing liquids. An insert 10 provides a ridge for attaching the pistol handle assembly 2. The insert 10 and vertical action valve assembly 11 are held in place with the valve locking ring 4. Valves comprise a needle valve seal 13 that prevents leakage from the receptor body 5, a needle valve seat 14, a detente which prevents the needle valve stem 17 from being removed completely from the needle valve seat 14, a needle valve stem seal 16 that prevents leakage from the needle valve seat 14, and the needle valve stem 17. Two threaded tubing connector receptors 18 permit the attachment of tubing connector assemblies 7, which are shown in FIG. 2.

FIG. 4 depicts a cross section of an assembled handheld receptor 1. Two threaded tubing connector receptors 18 permit the attachment of tubing connector assemblies 7, which are shown in FIG. 2. A receptor body incorporates an vertical action valve assembly 11 which provides a actuator 12 for dispensing liquids. The vertical action valve assembly 11 is held in place with the valve locking ring 4. Two valve assemblies 6 provide control of the liquid to be dispensed and the purging gas.

FIG. 5 depicts a cross section of a receptor body 5 with a number of bores that facilitate the flow of liquid or purging gas within the receptor body 5. These bores are created with a drill or other removal tool, or are incorporated into a mold to prevent material from filling the spaces. Two valve access bores 19 are created from the top of the receptor body 5, stopping when they reach the feed bore 21. The feed bore 21 traverses the receptor body 5 from one side to the other, passing through a point in the center of the cylindrical receptor body 5 when viewed from the top. Two smaller valve bores 20 create a channel for material to flow from an open needle valve assembly 6 through the feed bore 21 and into the cavity substantially filled by the vertical action valve assembly 11. Two transfer bores 22 are created by drilling from the bottom of the receptor body, in two parallel paths, and carry material from the bottom of the receptor body 5 to the valve assemblies 6. Two inlet traverse bores 23 are produced by drilling from the outside surface of the cylindrical receptor body, stopping when they reach the transfer bore 22. Two connector bores 24 are made from the bottom surface of the receptor body 5, stopping when they reach the inlet transverse bore 23. The connector bores 24 are enlarged and machined to form a threaded tubing connector receptor 18 for the liquid to be dispensed and the purging gas. Tapered plugs are inserted into the various bores in order to form a receptor body 5 as depicted in FIG. 4. The tapered plugs are trimmed to a length that will not impede any right angle flows of liquid or gas within the receptor body 5, and are pressed in place with a machine press that exerts three thousand pounds per square inch of pressure upon each plug.

FIGS. 6*a*, 6*b*, and 6*c* show a side, top, and bottom view of the receptor body 5. FIG. 6*a* shows a side view in perspective, and depicts the feed bore 21 and one of the inlet transverse bores 23. Both the feed bore 21 and the inlet transverse bores 23 are plugged with tapered plugs, inserted under pressure. FIG. 6*b* shows a top view, and depicts the connector bores 24 prior to plugs inserted. FIG. 6*c* shows a bottom view of the receptor body 5, and shows the threaded tubing connector receptors 18 that are enlarged after the connector bores 24 are created. The transfer bores 22 are machined and then plugged with tapered plugs. The two flat surfaces 26 are depicted, which permit the cylindrical receptor body 5 to be firmly held with a wrench or vise.

FIGS. 7*a* and 7*b* show the needle valve assembly 6 in an open and closed position. FIG. 7*a* depicts the needle valve assembly 6 in a closed position. The needle valve assembly 6 is placed in this position by turning the needle valve stem 17 clockwise until the needle valve stem 17 seats firmly in the needle valve seat 14. A needle valve stem seal 16 prevents leakage of the controlled material from the needle valve assembly 6. FIG. 7*b* shows the needle valve assembly 6 in an open position. The needle valve assembly 6 is places in this state by turning the needle valve stem 17 in a counter-clockwise direction.

FIG. 8 shows the needle valve assembly 6 in an open position, wherein the needle valve stem 17 is prevented from disengaging from the needle valve seat 14 by means of a detente pin 15 which restricts the path of the needle valve stem 17. A valve transfer bore 25 permits the flow of material to leave the needle valve assembly 6 when the needle valve assembly 6 is in an open position.

FIG. 9 depicts the simplest embodiment of the handheld receptor 1. A receptor body 5 incorporates an vertical action valve assembly 11 held in place by an valve locking ring 4. FIG. 10 depicts the receptor body 5 for this minimal implementation, with a threaded tubing connector receptor 18 shown that provides a liquid to be dispensed which does not require that the actuator 12 be purged. A solvent, for example, will evaporate and not clog the actuator 12, if left in the actuator 12 after use.

FIG. 11 depicts a non-purging version of the handheld receptor 1. An optional pistol handle assembly 2 is attached to the handheld receptor 1 by means of an insert 10. The insert 10 and vertical action valve assembly 11, which includes a actuator 12, and is attached to the receptor body by means of an valve locking ring 4. A tubing connector assembly 7 mechanically attaches a tubing supplying a liquid under pressure to the handheld receptor 1. Two parallel flat edges provide a means of firmly gripping the receptor body 5 when the valve locking ring 4 is tightened.

FIG. 12 depicts a perspective isometric view of the preferred embodiment, with the optional pistol handle assembly 2 in place. A receptor body 5 incorporates an vertical action valve assembly 11 which provides a actuator 12 for dispensing liquids. An insert 10 provides a ridge for attaching the pistol handle assembly 2. The insert 10 and vertical action valve assembly 11 are held in place with the valve locking ring 4. The receptor body 5 may be held stationary by means of two parallel flat surfaces 26 secured with a traditional wrench or vise. Two tubing connector assemblies 7 provide for the secure attachment of tubing that supplies propellant for purging the actuator 12, and liquid to be dispensed through the actuator 12. Valves comprise a needle valve seal 13 that prevents leakage from the receptor body 5, a needle valve seat 14, a detente which prevents the needle valve stem 17 from being removed completely from the needle valve seat 14, a needle valve stem seal 16 that prevents leakage from the needle valve seat 14, and the needle valve stem 17.

Figure 1:
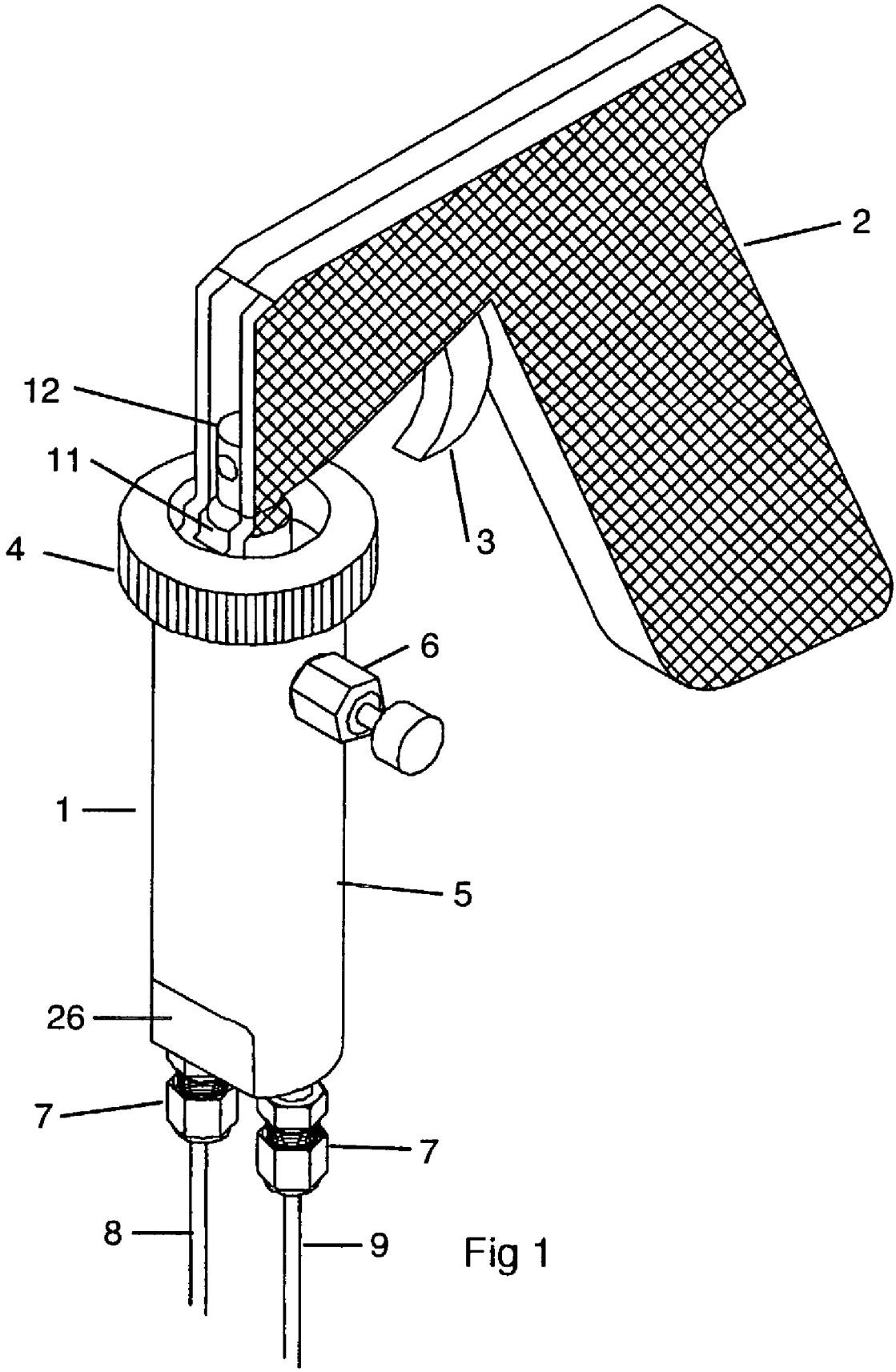
FIG. 1 shows a perspective view of the preferred embodiment, viewed from a point above, to the side, and to the front of the invention.
Figure 2:
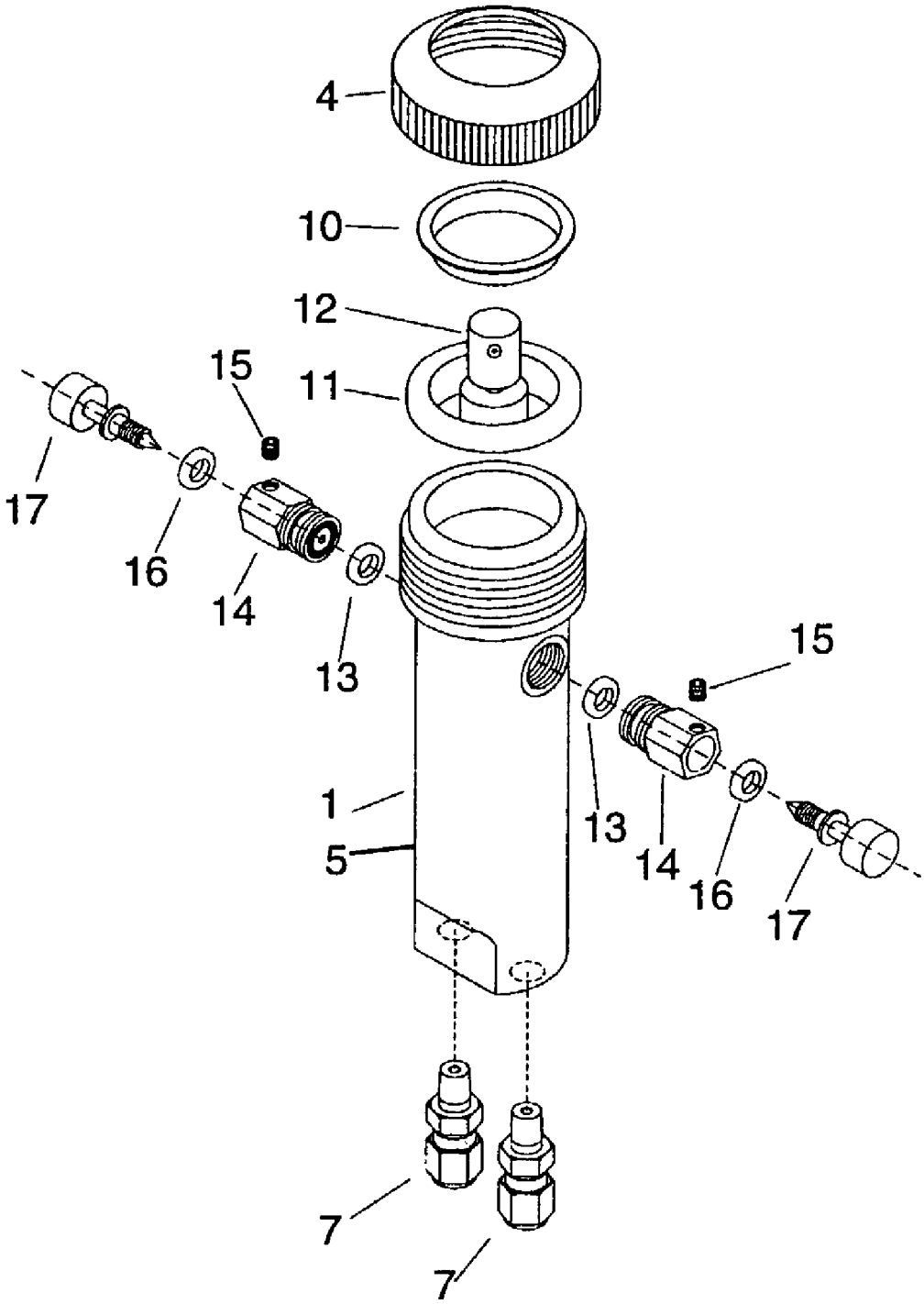
FIG. 2 shows a perspective of an explosion view of the parts that make up the preferred embodiment.
Figure 2A:
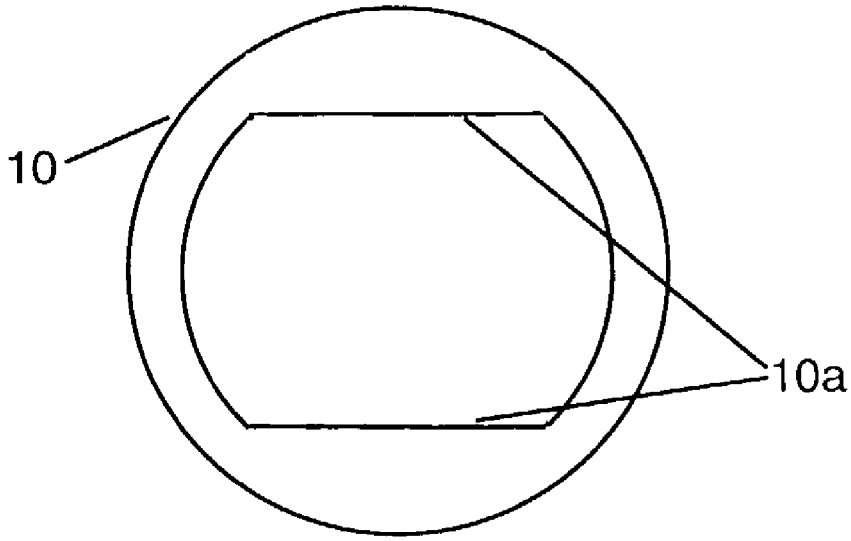
FIG. 2*a* shows a top view of the preferred design for the insert.
Figure 2B:
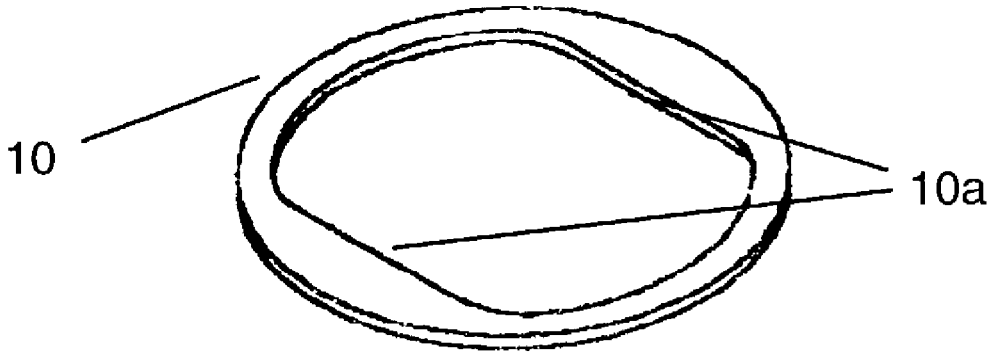
FIG. 2*b* shows a perspective view of the preferred design for insert.
Figure 3:
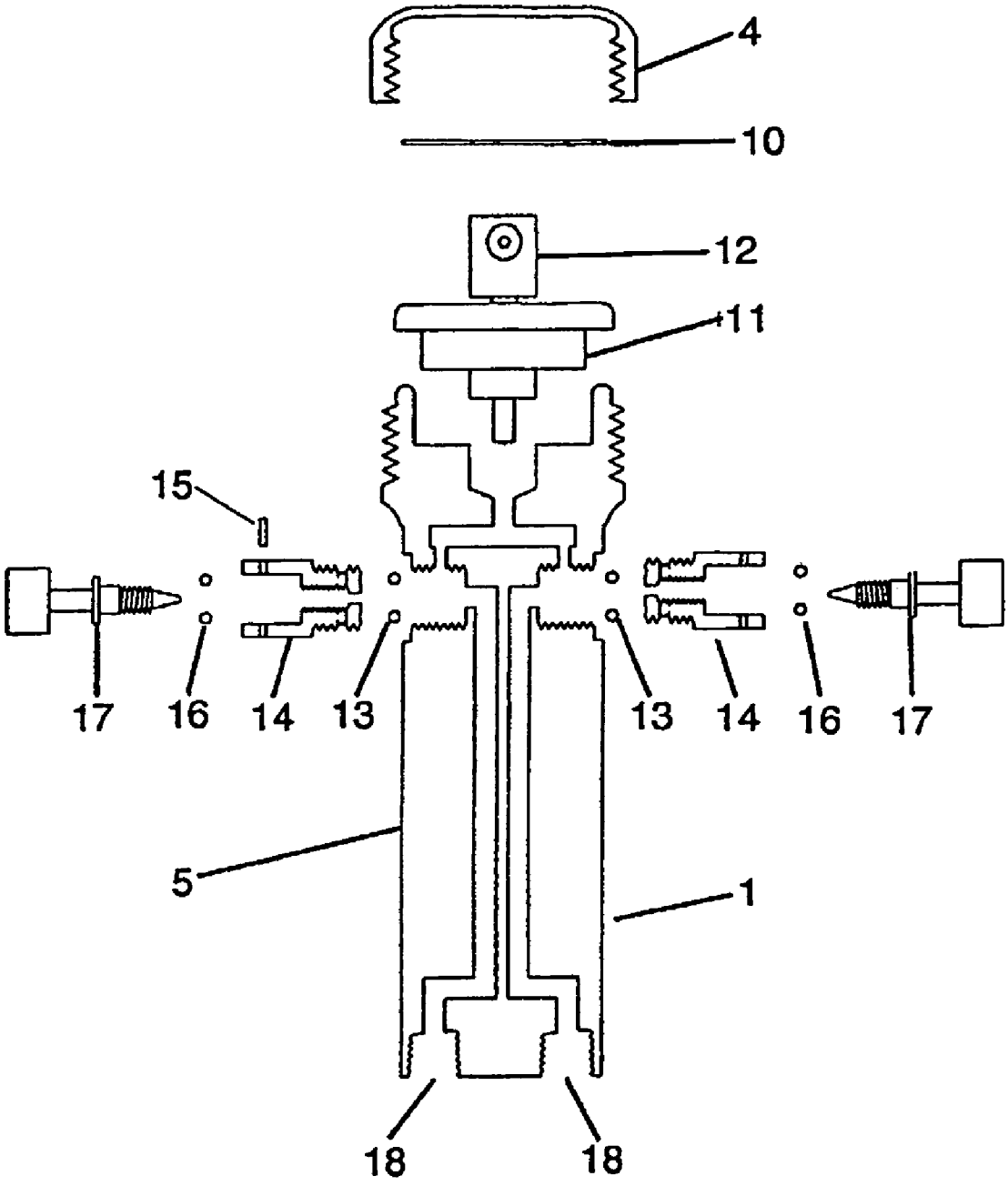
FIG. 3 shows a cross section explosion view of the invention, taking a cross section as viewed from the front of the invention.
Figure 4:
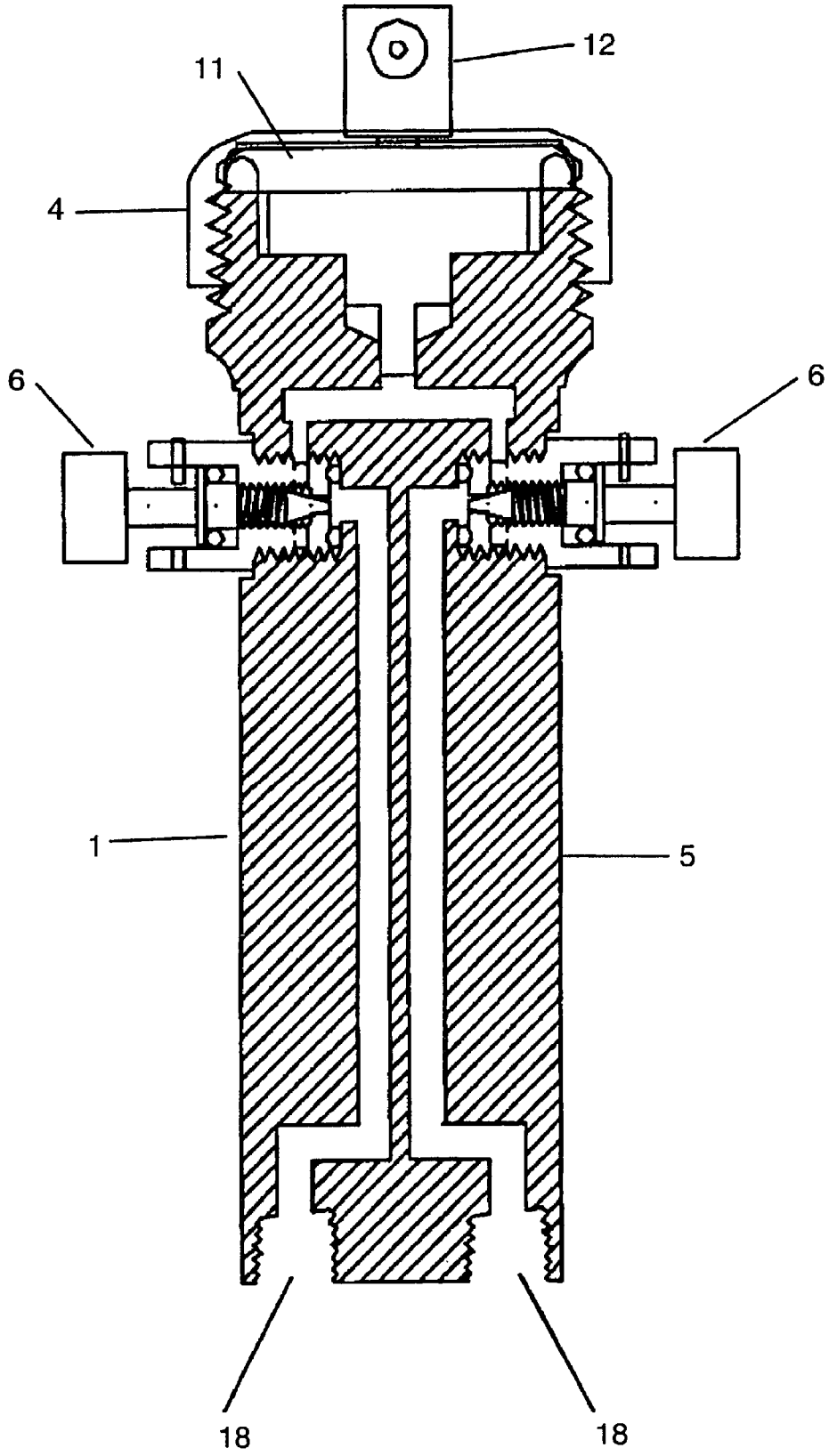
FIG. 4 shows a cross section of the assembled invention, excluding the pistol grip and the intake tubing attachment apparatus.
Figure 5:
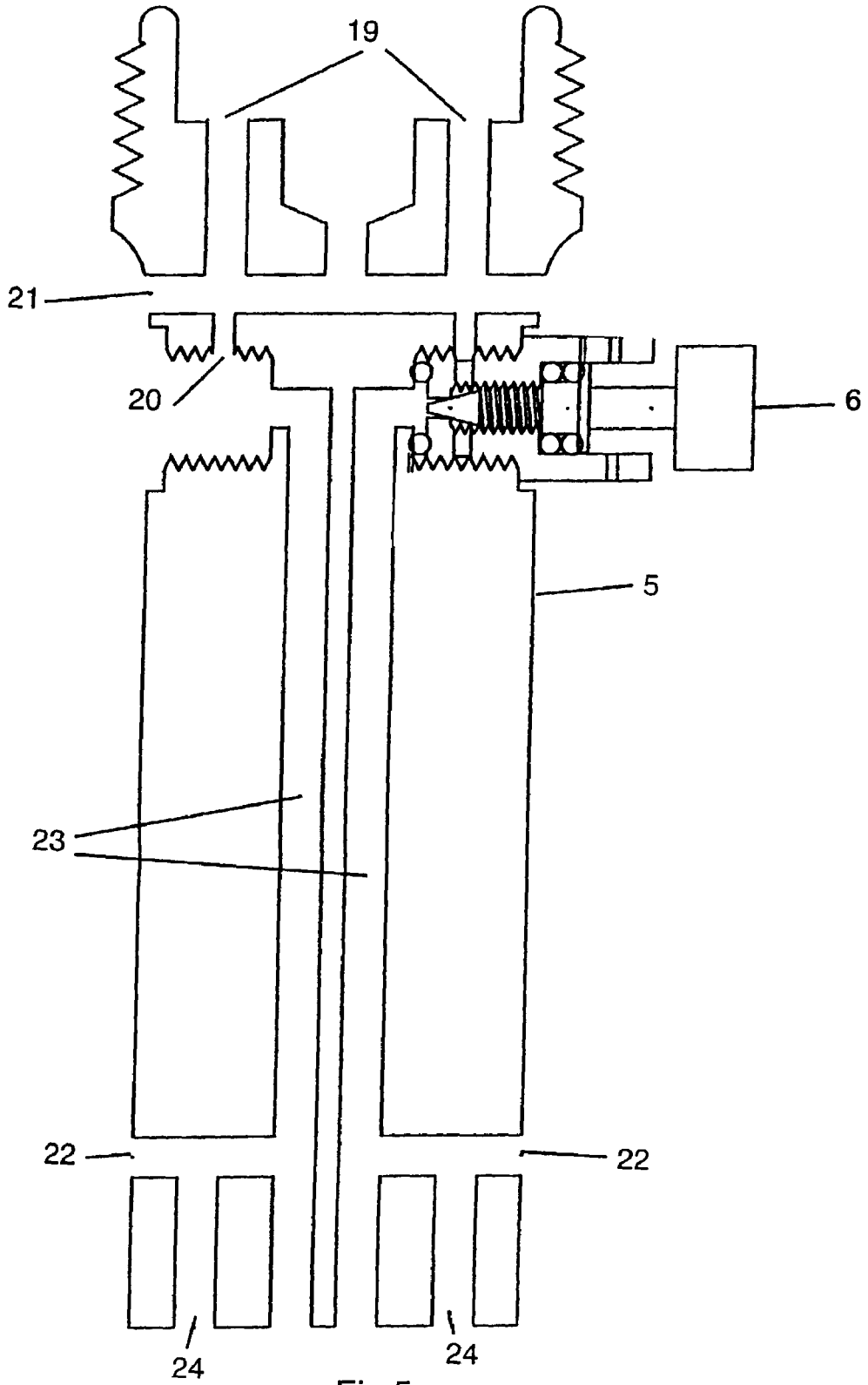
FIG. 5 shows a cross section viewed from the front, prior to the insertion of plugs.
Figure 6A:
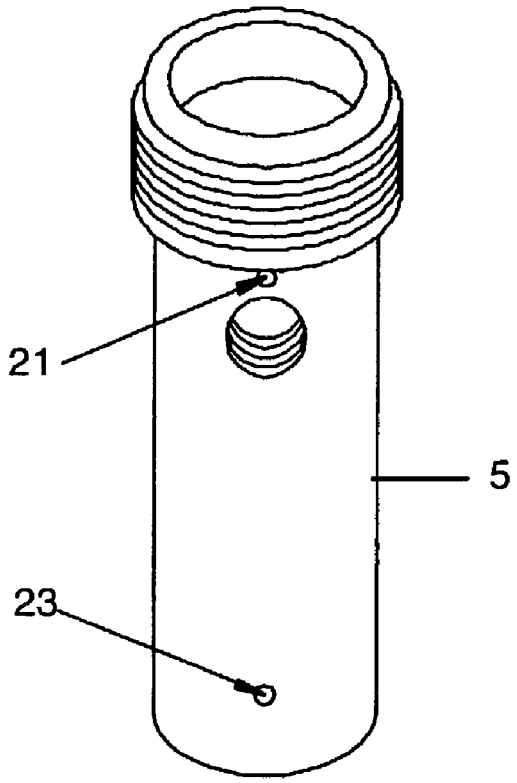
FIG. 6*a* shows a view from the side, prior to the insertion of plugs. A view of the other side is symmetrical and identical.
Figure 6B:
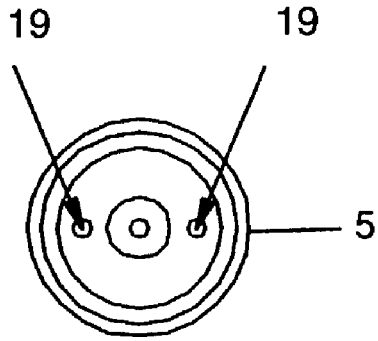
FIG. 6*b* shows a view from the top, prior to the insertion of plugs.
Figure 6C:
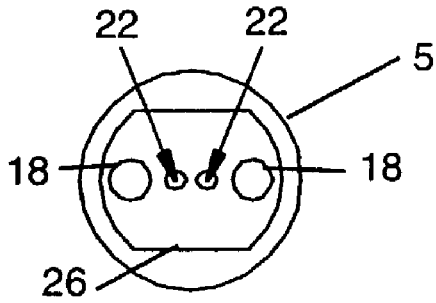
FIG. 6*c* shows a view from the bottom, prior to the insertion of plugs.
Figure 7A:
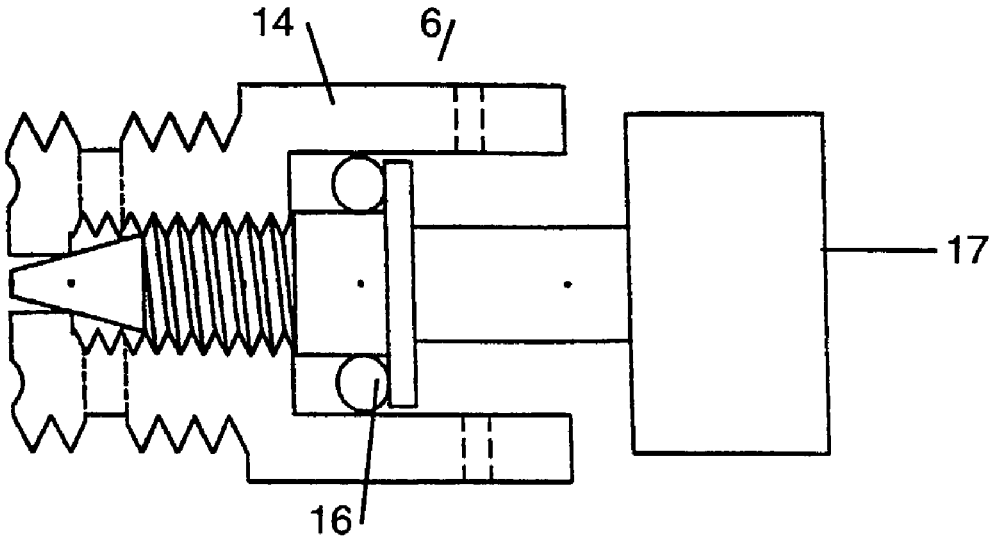
FIG. 7*a* shows a needle valve assembly in the closed position.
Figure 7B:
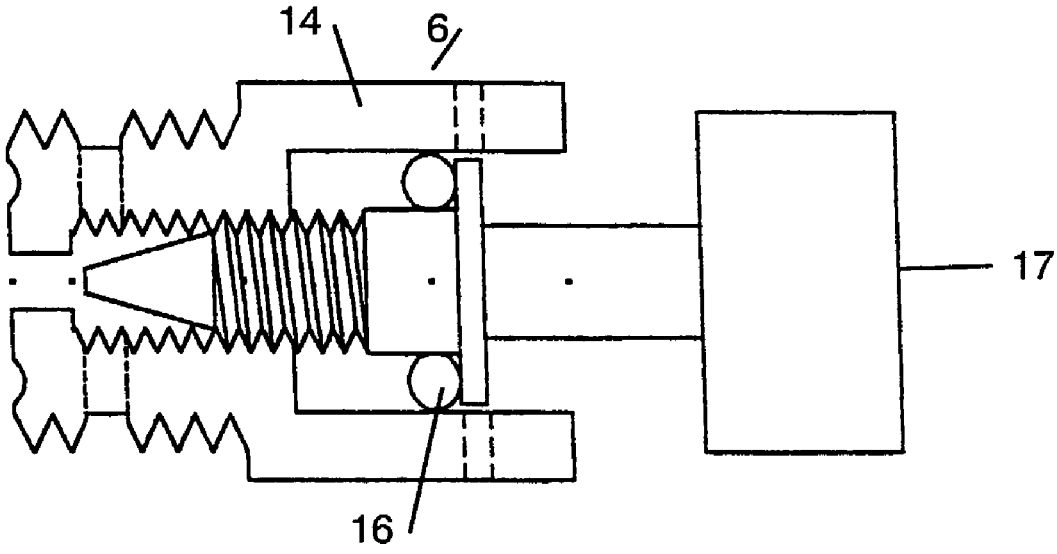
FIG. 7*b* shows a needle valve assembly in the open position.
Figure 8:
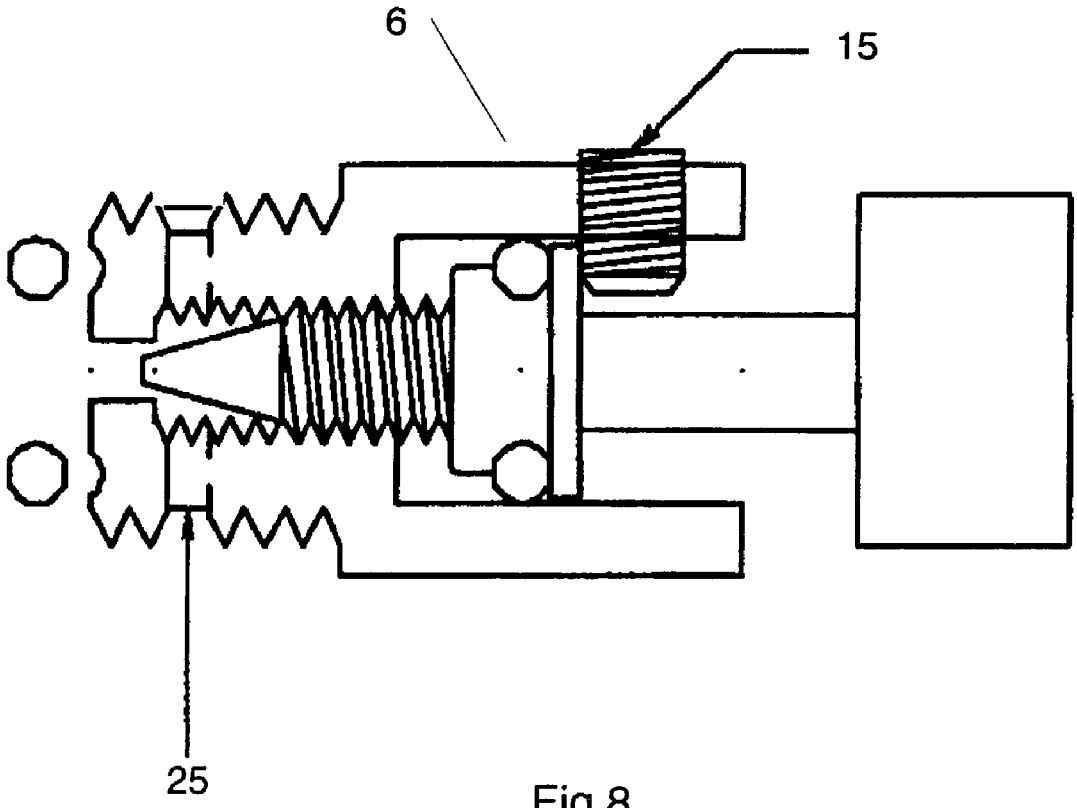
FIG. 8 shows the needle valve assembly with a detente in place, to prevent the inadvertent removal of the needle valve stem from the valve.
Figure 9:
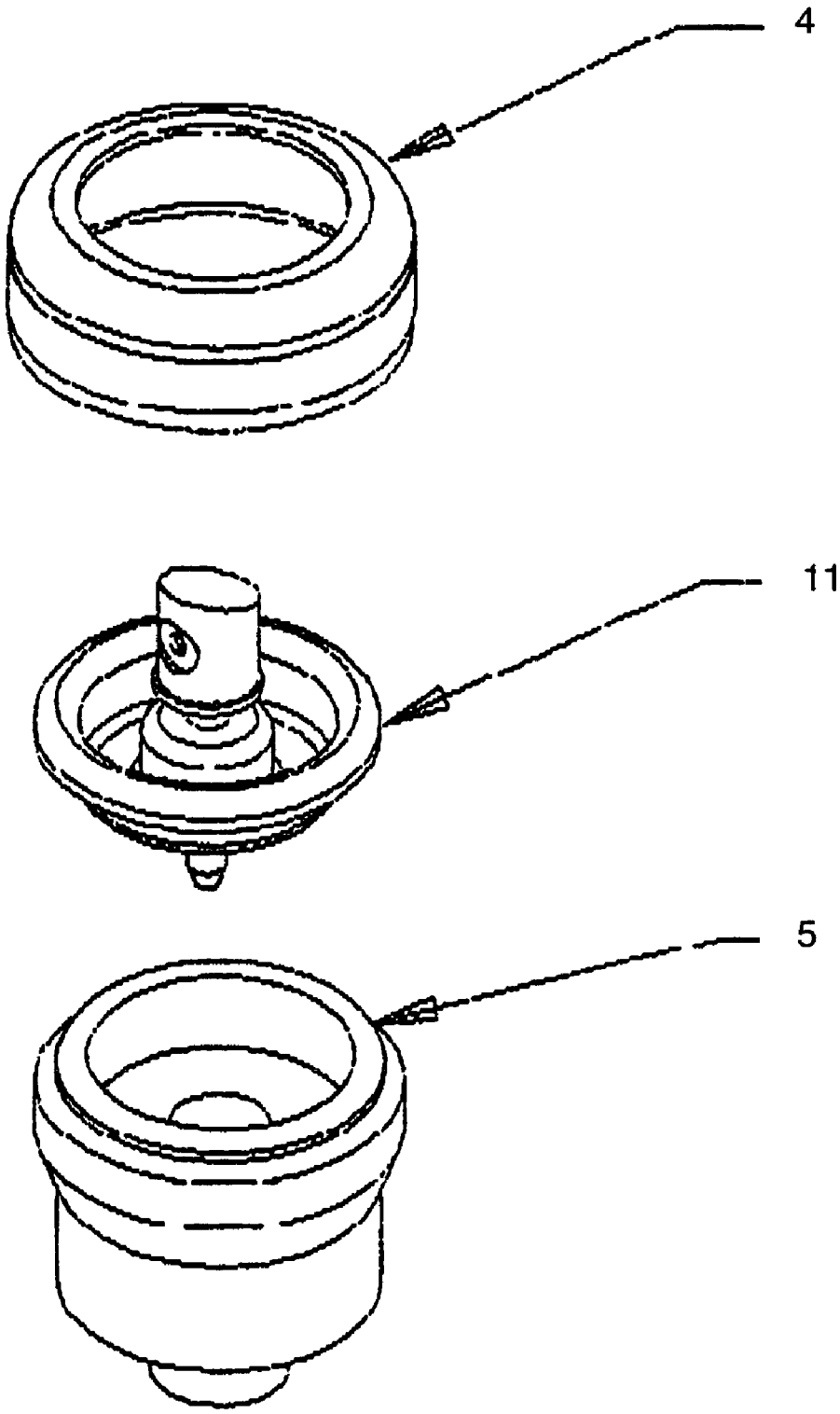
FIG. 9 shows an embodiment of the invention which has but one inlet.
Figure 10:
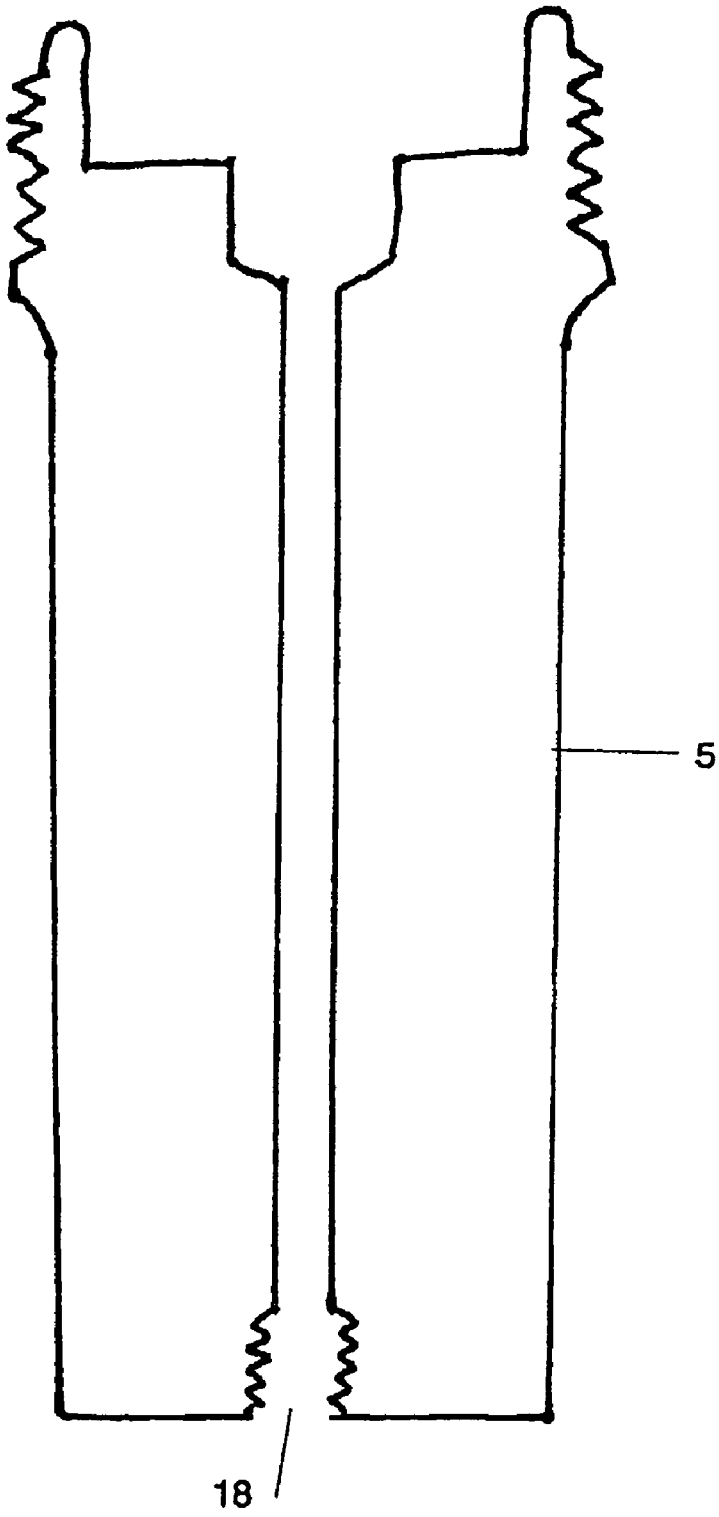
FIG. 10 shows a cross section of the body of the simplified embodiment with one inlet.
Figure 11:
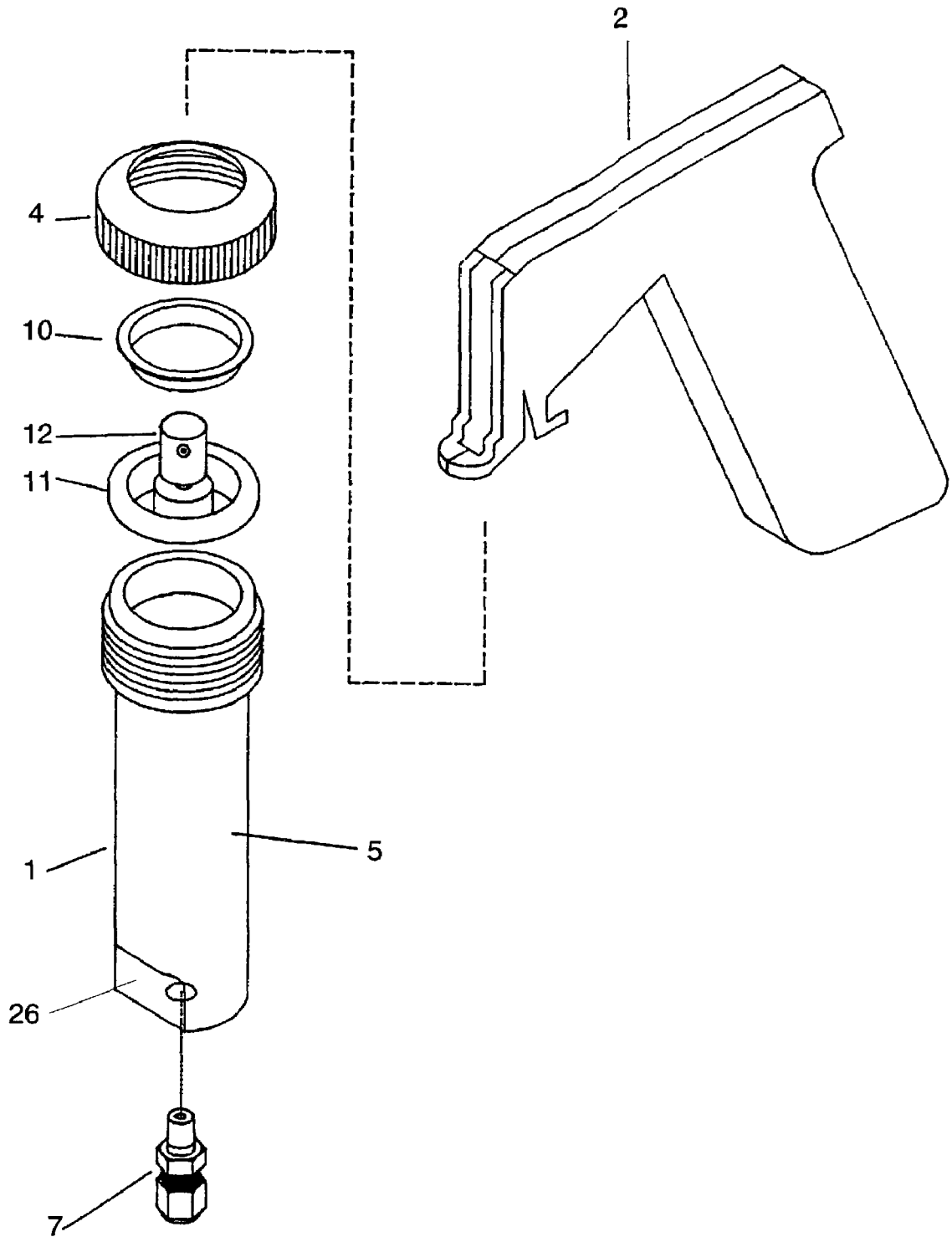
FIG. 11 shows a perspective isometric of the simplified embodiment of the invention, to include the grip assembly.
Figure 12:
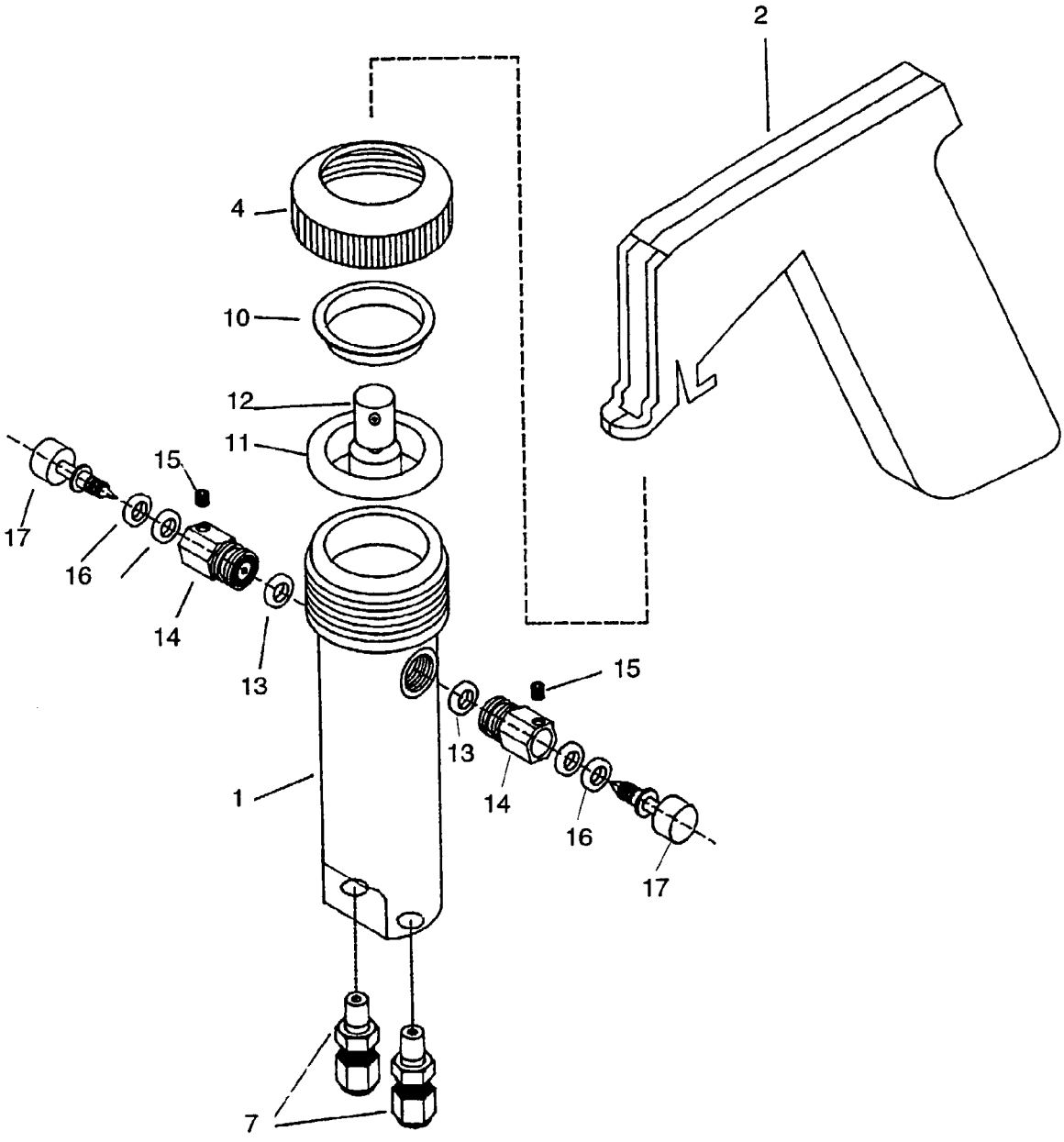
FIG. 12 shows a perspective explosion view of the preferred embodiment, to include the grip assembly and intake attachment assemblies.

I claim:

1. A handheld receptor, with a purging capability, consisting of a cylindrical receptor body with a threaded upper end, a commercially available vertical action valve assembly, a valve locking ring, and two needle valve assemblies, (a) said valve locking ring threaded to mate with said threaded upper end of said receptor body, and having an opening through which said vertical action valve may extend, configured so that when said valve locking ring is tightened to said threaded upper end of said receptor body, (b) said vertical action valve is seated firmly to said receptor body, said receptor body configured to receive said vertical action valve into a chamber that is configured to receive said vertical action valve with a minimum of space and volume between said vertical action valve and said receptor body, (c) said receptor body having two bores commencing from the bottom flat surface of said receptor body, extending to two needle valves, and thereafter to the chamber into which said vertical action valve is seated, (d) the first of said needle valves being configured to supply a flow of liquid material to an actuator on said vertical action valve, when said first needle valve is in the open position, so as to permit liquid material under pressure to flow when an operator depresses the actuator on said vertical action valve assembly, (e) the second of said needle valves being configured to supply a flow of compressed gas when said second needle valve is in the open position, so as to purge any liquid material in said receptor body and said vertical action valve, when an operator depresses said actuator on said vertical action valve assembly, (f) said handheld receptor with either both needle valves closed, or said first needle valve open and second needle valve closed for normal operation, or said first needle valve closed and said second needle valve open for cleaning and purging of said handheld receptor, (g) said needle valves constructed to withstand operating pressures of both the gas and liquid supplied to said handheld receptor under pressure, without leaking.

2. A handheld receptor as in claim 1, wherein an insert is placed between said vertical action valve and said valve locking ring, (a) said insert having a cylindrical portion configured to fit snugly within the well of said vertical actuator valve and having an outer lip and an inner lip, (b) said outer lip extending outward from said cylindrical portion and resting on the top cylindrical surface of said vertical action valve so as to secure said insert on top of said vertical action valve, (c) said inner lip extending inward so as to form a lip suitable for attaching a spray nozzle assembly, said inner lip and said outer lip presenting a flat surface when viewed from above, (d) said inner lip defining a circular opening modified by two extended edges which define two straight opposing edges, said straight edges providing a front and back edge for securing said spray nozzle assembly securely to said handheld receptor, (e) said spray nozzle assembly attaching to said handheld receptor by inserting said spray nozzle assembly into the elongated opening defined by said insert, and thereafter rotating said spray nozzle assembly one quarter turn, so that the front and back edges of said spray nozzle assembly grip to the lips defined by the straight edges of said insert.

3. A handheld receptor as in claim 1, wherein an insert is placed between said vertical action valve and said valve locking ring, (a) said insert having a flat upper and lower surface, parallel to one another, and a circular outer edge, of a diameter which fits snugly within said valve locking ring, said insert having an inner opening consisting of two circular edges of a diameter that is slightly larger than that of the crimped edge of an aerosol can, said circular edges being opposite of one another and each occupying approximately ninety degrees of said opening, (b) said insert having two straight edges connecting said circular edges one to another, providing a narrower opening suitable for gripping by an external pistol grip assembly, when said pistol grip assembly is inserted parallel to said straight edges and thereafter twisted ninety degrees.

4. A handheld receptor as in claim 1, wherein said receptor body is comprised of machined aluminum, machined brass, or injection molded plastic materials, said injected molded part being molded in two parts and thereafter assembled.

5. A handheld receptor as in claim 1, wherein said needle valves comprise:

a first O-ring of Butyl, Buna, Teflon, rubber or other synthetic material selected to prevent leaking of the dispensed liquid, a needle valve seat with a male threaded end and a female threaded interior, said male threaded end configured to be secured to said handheld receptor body with said first O-ring inserted into said handheld receptor body first, and secured by means of said needle valve assembly, a second O-ring of Butyl, Buna, Teflon, rubber or other synthetic material selected to prevent leaking of the dispensed liquid, smaller in diameter than said first O-ring, and configured to fit within said female threaded interior of said needle valve seat, a needle valve stem with a threaded end configured to insert into said female threaded interior of said needle valve seat, into which said second O-ring is first inserted to form a tight seal and prevent leakage of material under pressure, a detente pin, threaded and inserted into the wall of said needle valve seat, extending into the interior of said needle valve seat so as to prevent the inadvertent removal of said needle valve stem through the inadvertent opening of the valve with too many turns.

6. A handheld receptor as in claim 1, which is manufactured by means of precision drilling equipment to form the interior bores, leaving additional bores that are filled with tapered plugs made of the same material as said handheld receptor body, said tapered plugs being inserted under mechanical pressure that significantly exceeds the operating pressure of the completed assembly.

7. A handheld receptor as in claim 1, for which two tubing connector assemblies are threaded and inserted in the bottom of said handheld receptor body, in two female threaded seats configured to provide a tight and leakproof seat, configured to provide a tight mechanical coupling to two inlet tubes that supplies liquid material to be dispensed, and a gas for purging the handheld receptor.

* * * * *